US012446611B2

(12) United States Patent
Del Borrello

(10) Patent No.: US 12,446,611 B2
(45) Date of Patent: Oct. 21, 2025

(54) METHOD AND APPARATUS FOR PRODUCING A PLURALITY OF SHEETS OF MATERIAL CONTAINING ALKALOIDS

(71) Applicant: PHILIP MORRIS PRODUCTS S.A., Neuchatel (CH)

(72) Inventor: Michele Del Borrello, Vasto (IT)

(73) Assignee: Philip Morris Products S.A., Neuchatel (CH)

( * ) Notice: Subject to any disclaimer, the term of this patent is extended or adjusted under 35 U.S.C. 154(b) by 796 days.

(21) Appl. No.: 17/414,080

(22) PCT Filed: Dec. 18, 2019

(86) PCT No.: PCT/EP2019/086099
§ 371 (c)(1),
(2) Date: Jun. 15, 2021

(87) PCT Pub. No.: WO2020/127588
PCT Pub. Date: Jun. 25, 2020

(65) Prior Publication Data

US 2022/0039454 A1 Feb. 10, 2022

(30) Foreign Application Priority Data

Dec. 18, 2018 (EP) ..... 18213653

(51) Int. Cl.
*A24B 3/14* (2006.01)

(52) U.S. Cl.
CPC ..... *A24B 3/14* (2013.01)

(58) Field of Classification Search
CPC ..... A24B 3/14
See application file for complete search history.

(56) References Cited

U.S. PATENT DOCUMENTS 3,098,492 A 7/1963 Wurzburg
3,870,054 A * 3/1975 Arledter ..... A24B 3/14 131/370

(Continued)

FOREIGN PATENT DOCUMENTS

DE 20 06 035 8/1971
DE 20 06 036 8/1971

(Continued)

OTHER PUBLICATIONS

DE2006035a1, "No tittle" (Year: 1971).*

(Continued)

*Primary Examiner* — Parviz Hassanzadeh
(74) *Attorney, Agent, or Firm* — Mueting Raasch Group

(57) ABSTRACT

The invention relates to a method for the production of a plurality of sheets of a material containing alkaloids, the method including the steps of: •(100) providing a slurry including a material containing alkaloids and water in a tank; •(101) providing the tank with a plurality of outlets; •(102) supplying slurry from the outlets on a movable support so as to form a plurality of parallel sheets of material containing alkaloids; and•keeping the parallel sheets of material containing alkaloids separated on the movable support while moving the movable support. The invention also relates to an apparatus (1) for the production of a plurality of sheets of a material containing alkaloids.

7 Claims, 3 Drawing Sheets

(56) References Cited

U.S. PATENT DOCUMENTS

| | | | | |
|---|---|---|---|---|
| 4,681,126 | A * | 7/1987 | Strubel | A24B 3/14 131/370 |
| 4,702,264 | A * | 10/1987 | Graves, Jr. | A24B 3/14 131/370 |

FOREIGN PATENT DOCUMENTS

| | | | |
|---|---|---|---|
| DE | 2006035 | A1 * | 8/1971 |
| DE | 20 54 211 | | 5/1972 |
| DE | 2054211 | A1 * | 5/1972 |
| WO | WO 2017/089589 | | 6/2017 |

OTHER PUBLICATIONS

DE2054211a1, "No title" (Year: 1972).*
Office Action issued in Japan for Application No. 2021-534806 dated Jan. 4, 2024 (8 pages). English translation included.
PCT Search Report and Written Opinion for PCT/EP2019/086099 dated Mar. 30, 2020 (13 pages).

* cited by examiner

METHOD AND APPARATUS FOR PRODUCING A PLURALITY OF SHEETS OF MATERIAL CONTAINING ALKALOIDS

This application is a U.S. National Stage Application of International Application No. PCT/EP2019/086099 filed Dec. 18, 2019, which was published in English on Jun. 25, 2020, as International Publication No. WO 2020/127588 A1. International Application No. PCT/EP2019/086099 claims priority to European Application No. 18213653.1 filed Dec. 18, 2018.

This invention relates to a method and an apparatus for producing a plurality of sheets of material containing alkaloids. In particular, the invention relates to a method and an apparatus for producing a plurality of sheets of material for use in an aerosol-generating article such as, for example, a cigarette or a "heat-not-burn" type alkaloids containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder, are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In the aforementioned process, the slurry is cast on a substrate, such as a moving belt, and then it is heated in order to obtain a sheet of material which can be further processed to obtain components for an aerosol generating article. The moving belt, with the cast sheet on it, moves inside long "dryers" where the temperature is controlled to progressively heat and dry the sheet.

After the drying of the sheet, which is relatively wide, the same is split in smaller sections, which are then wounded in "small" bobbins. Alternatively, a large "master bobbin" is created, winding the whole sheet in a "big" bobbin, and then stored. When the sheet needs to be further processed, the master bobbin is cut in smaller bobbins, easier to handle.

Every time these process steps are performed, there is always the risk of breaking the sheet or its smaller sections, due to the inherent fragility of the sheet and its "stickiness".

There is a need for a method and an apparatus that simplify the process above described taking care of the specific characteristics of the sheet of material including alkaloids to minimize damages to the same during manufacturing.

The invention relates to a method for the production of a plurality of sheets of a material containing alkaloids, the method including the steps of: providing a slurry including a material containing alkaloids and water in a tank; providing the tank with a plurality of outlets; supplying slurry from the outlets on a movable support so as to form a plurality of parallel sheets of a material containing alkaloids; and keeping the parallel sheets of material containing alkaloids separated on the movable support while moving the movable support.

According to the invention, a plurality of sheets is formed from the slurry at the same time. The sheets are disposed parallel to each other on the same movable support. In this way, there is no need of splicing the sheet after its production because already "smaller" sheets are produced, without lengthening the production, because several sheets are produced in parallel. Further, the smaller dimension of the sheets may also allow a faster and more uniform drying.

As used herein, the terms "sheet" denotes a laminar element having a width and length substantially greater than the thickness thereof. The combined width of the parallel sheets is preferably greater than about 10 millimetres, more preferably greater than about 20 millimetres or about 30 millimetres. Even more preferably, the width of the sheet of material containing alkaloids is comprised between about 60 millimeters and about 2500 millimeters. The thickness of the sheet of material containing alkaloids is preferably comprised between about 50 micrometers and about 300 micrometers, more preferably the thickness of the sheet is comprised between about 100 micrometers and about 250 micrometers, even more preferably between about 130 micrometers and 220 micrometers.

A continuous "sheet" is herein called "web".

As used herein, the term "movable support" denotes any means comprising a surface that can be moved in at least one longitudinal direction. The movable support may form a closed loop so as to provide an uninterrupted transport in one direction. The movable support may include a conveyor belt. The movable support may be essentially flat and may show a structured or an unstructured surface. The movable support may have no openings on its surface or may include orifices, preferably of such a size that they are impenetrable for the slurry deposited on it. The movable support may comprise a sheet-like movable and bendable band. The band may be made of a metallic material, including but not limited to steel, copper, iron alloys and copper alloys. The band may be made of rubber. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behavior.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

Preferably, the material containing alkaloids includes a homogenized tobacco material. In this case therefore the alkaloid is nicotine. As used herein, the term "homogenised tobacco material" denotes material formed by agglomerating particulate tobacco, which contains the alkaloid nicotine.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder. Further, it may include an aerosol-former, such as guar and glycerin.

The term "aerosol-forming substrate" refers to a substrate that is capable of releasing volatile compounds that may form an aerosol. Typically, aerosol-forming substrates release volatile compounds upon heating. The aerosol-forming substrate may include the material containing alkaloids containing volatile alkaloids flavor compounds, which are released from the aerosol-forming substrate upon heating. The aerosol-forming substrate may include homogenized material.

In order to form a sheet of material containing alkaloids, a slurry is formed.

The slurry may comprise a number of different components or ingredients. These components may influence the properties of the cast sheet of material containing alkaloids. A first ingredient is a material containing alkaloids, for example in powder form. This material can be for example a tobacco powder blend, which preferably contains the majority of the tobacco present in the slurry. The tobacco powder blend is the source of the majority of tobacco in the homogenized tobacco material and thus gives the flavour to the final product, for example to an aerosol produced by heating the homogenized tobacco material.

Preferably, the powder of material containing alkaloids has a size of between about 0.03 millimetres and about 0.12 millimetres. With size of the particle or powder of the material containing alkaloids, the Dv95 size is meant. Each of the values above listed indicates the Dv95 of the particle size. The "v" in Dv95 means that a volume distribution is considered. The use of volume distributions introduces the concept of the equivalent sphere. An equivalent sphere is a sphere which is equal to the real particle in the property which we are measuring. Thus for light scattering methods, it is a sphere which would produce the same scattering intensities as the real particle. This is substantially a sphere having the same volume of the particle. Further, "95" in Dv95 means the diameter where ninety-five percent of the distribution has a smaller particle size and five percent has a larger particle size. Thus the particle size is that size according to a volume distribution where 95 percent of the particles have a diameter (of the corresponding sphere having substantially the same volume of the particle) smaller than the stated value. A particle size of 60 microns means that 95 percent of the particles have a diameter smaller than 60 microns, where the diameter is the diameter of the sphere having a corresponding volume than the particle.

The Dv95 size of the particle is measured using a Horiba LA 950 or LA 960 particle size distribution analyser. The HORIBA LA-960 particle size analyser uses the laser diffraction method to measure size distributions. This technique uses first principles to calculate size using light scattered off the particle (edge diffraction) and through the particle (secondary scattering refraction). The LA-960 incorporates the Mie scattering theory.

A binder may be added to the slurry in order to enhance the tensile properties of the homogenized sheet. An aerosol-former may be added to the slurry to promote the formation of aerosol. Further, in order to reach a certain viscosity and moisture optimal for casting the web of material containing alkaloids, water may be added to the slurry.

The quantity of binder added to the slurry may be comprised between about 1 percent and about 5 percent in dry weight of the slurry. More preferably, it is comprised between about 2 percent and about 4 percent. The binder used in the slurry may be any of the gums or pectins described herein. The binder may ensure that the powder of material containing alkaloids, such as tobacco, remains substantially dispersed throughout the homogenized tobacco web. Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Suitable aerosol-formers for inclusion in slurry for material containing alkaloids are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerine and propylene glycol.

The slurry may have an aerosol-former content of greater than about 5 percent on a dry weight basis. The slurry may have an aerosol former content of between about 5 percent and about 30 percent by weight on a dry weight basis. More preferably, the aerosol-former is comprised between about 10 percent to about 25 percent of dry weight of the slurry. More preferably, the aerosol-former is comprised between about 15 percent to about 25 percent of dry weight of the slurry.

A cellulose pulp containing cellulose fibres is preferably added to the slurry in order to increase the tensile strength of the alkaloids material web, acting as a strengthening agent.

The introduction of cellulose fibres in the slurry typically increases the tensile strength of the sheet of material containing alkaloids, acting as a strengthening agent. Therefore, adding cellulose fibres may increase the resilience of the sheet of material containing alkaloids. Cellulose fibres for including in a slurry for sheet of material containing alkaloids are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively, fibres, such as vegetable fibres, may be used either with the above fibres or in the alternative, including hemp and bamboo. The length of cellulose fibres is advantageously between about 0.2 millimetres and about 4 millimetres. Preferably, the mean length per weight of the cellulose fibres is between about 1 millimetre and about 3 millimetres. Further, preferably, the amount of the cellulose fibres is comprised between about 1 percent and about 7 percent in dry weight basis of the total weight of the slurry (or homogenized tobacco sheet).

The mean length of the fibers refers to their real length (regardless whether they are curled or have kinks) as measured by MORFI COMPACT commercialised by Techpap SAS. The mean length is the mathematical mean of the measured length of the fibers by MORFI COMPACT over a measurement of N fibers, where N>5. The MORFI COMPACT is a fiber analyser that measures the length of the fibers following the framework of the fibers, thus measuring their real developed length. Measured objects are considered fibers if their length is comprised between 200 microns and 10000 microns and their width is comprised between 5 microns and 75 microns. Fibers length is measured when deionized water is added to the fibers and Morfi software is used.

The binder and the cellulose fibres are preferably included in a weight ratio comprised between about 1:7 and about 5:1. More preferably, the binder and the cellulose fibres are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

Preferably, the alkaloid containing material is tobacco. The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The slurry formed with the material containing alkaloids, water and preferably some or all ingredients above described may be for example contained in a tank. The slurry may reach the tank from a different location. The tank therefore may not be the place where the slurry is formed. For example, the slurry may be created in a silo, from where it is transferred to the tank via suitable piping.

The slurry inside the tank is preferably kept at about ambient temperature, that is, between about 15 degrees Celsius and about 30 degrees Celsius.

From the tank, the slurry is transferred to a movable support to form a plurality of sheets. Preferably, the sheets are formed on a surface of the movable support, for example a conveyor belt. The direction along which the movable support moves defines a transport direction.

Preferably, the tank is located above the movable support and the surface of the movable support on which the sheets are formed forms preferably a substantially horizontal surface.

Preferably, the slurry is continuously supplied to the tank while the slurry is supplied onto the movable support to form a plurality of continuous sheets of material containing alkaloids. The silo and the tank are thus preferably fluidly connected in order to allow the slurry flow from one to the other.

Preferably, the level of slurry is checked inside the tank, for example by means of a suitable sensor. Preferably, the slurry is introduced in the tank by means of a pump. More preferably, there is a feedback control loop, wherein signals from the sensor regarding the slurry's level may change the pump output.

In this way, preferably a pre-defined amount of slurry is maintained in the tank.

The tank is preferably box-shaped. Preferably, the tank includes walls. More preferably, the walls in turn comprise sidewalls. The sidewalls may include a first and a second couple of opposite walls, called first, second, third and fourth sidewall. The sidewalls are advantageously substantially vertical, or tilted with respect to a vertical plane. First and second sidewall, and third and fourth sidewall, are one facing the other. Preferably, the walls of the tank also include a bottom wall.

The tank includes a plurality of outlets. The outlets are for example formed on a wall of the tank, for example in the bottom wall. The outlets formed in the tank can be arranged in any configuration. Preferably, they are distributed along a line. The outlets can be located at the end of pipes extending from the tank. In this case, the tank may have one aperture—for example in the bottom wall—from which a main pipe extends. The main pipe then branches off in a plurality of pipes, each ending with an outlet. Alternatively, a plurality of apertures is formed in the tank—for example in the bottom wall—from which a plurality of pipes extends, each starting from an aperture and ending with an outlet. In this case, therefore, the outlets may be located at the end of pipes, which supply the slurry to the movable support.

Slurry is distributed from the outlets to the movable support.

The slurry may be applied directly on the movable support, or one or more substrate sheets may be interposed between the movable support and the tank, so that the slurry is applied to the substrate sheet. The substrate sheet may be positioned on the movable support.

Preferably, the distance between two nearest neighbour outlets remains constant among all outlets.

Considering the bottom wall of the tank as defining a (X,Y) plane, with X parallel to the transport direction, and the lateral walls extending, at least for a component, along the Z axis parallel to the (X,Y) plane, preferably the outlets form a line parallel to the Y axis. However, the outlets may be arranged in multiple parallel lines.

The moving support preferably moves along a longitudinal direction—the transport direction—in order to remove the slurry exiting from the outlets. The dimension of the movable support perpendicular to the transport direction is called the width of the movable support. The support may include for example a stainless steel movable belt. The support is preferably moved by a drum which is adapted to advance the movable support. The drum is further adapted to be in thermal contact with the movable support for the sheets of material containing alkaloids.

The plurality of outlets distributes the slurry onto the movable support, or on the substrate sheet placed on the movable support, in different locations. Due to the fact that the movable support moves along the transport direction, the distributed slurry forms different slurry sheets, one for each different outlet, extending along the transport direction. The dimension of the sheets formed on the movable support in a direction perpendicular to the transport direction is called the width of the sheet.

Preferably, the width of each of the sheet is preferably comprised between about 10 millimetres and about 300 millimetres. Preferably, all sheets which are formed at the same time from the outlets have substantially the same width.

Preferably, the sheets formed from the outlets are not overlapping, that is, each sheet is with one surface in contact with the movable support or the substrate sheet. The sheet does not lie on top of another sheet. There is preferably no contact among different sheets formed from different outlets.

The sheets are maintained separated one from the others during the movement of the movable support. Without keeping the sheets separated, due to the substantially liquid or pastry state of the slurry, the sheets would tend to combine with each other forming a single sheet. Thus, the parallel sheets which are formed by the outlets being located in different positions are kept separated while the movable support transports them along the transport direction.

In this way, a plurality of sheets is formed at the same time, each sheet having a relatively "small" width which is suitable for the further processing steps, for example for the formation of an aerosol generating article. Steps like splitting the sheet in a plurality of smaller sheets along the transport direction are avoided.

Preferably, at least on a section of the movable support, the substrate sheet is provided. Preferably a number of substrate sheets equal to the number of outlets is provided. The slurry is thus deposited above the substrate sheets so that, together, they form a plurality of sheets of material containing alkaloids.

The substrate sheet is preferably a substrate sheet including fibres. The substrate sheet may be used to form a sheet of material including alkaloids having a relatively high tensile strength. It may be used with slurry having a low fibres' content to strengthen the resulting sheets of material containing alkaloids.

The substrate sheet including fibres typically is a relatively "strong" sheet, the tensile strength of which is such that it can be transported between rollers, without the need of any additional substrate on which it has to be in contact with. The tensile strength of the substrate sheet is preferably comprised between about 0.1 Newton/(millimetres)$^2$ and about 1 Newton/(millimetres)$^2$.

The substrate sheet may be made of different materials, natural or synthetic, including cellulose, hemp, kenaf, bamboo pulp, cotton, silk, wood, or combination thereof. The selection of the material is done according to the mechanical properties expected for the final sheet including a material containing alkaloids.

The fibres in the substrate sheet could be woven or not woven. If not woven, the fibres may be oriented predominantly in one direction. Also, the fibres may be for example randomly oriented. If woven, various patterns could be used. The substrate sheet may include a mat of fibres. The fibres may be randomly arranged, flattened into a sheet or woven into a fabric. The substrate sheet may include a binder to hold the fibres together. The binder may include methyl cellulose.

Preferably, the substrate sheet is a braided sheet. A braided sheet is a sheet where the fibres are intertwined. Not all fibres need to be intertwined, but a fraction thereof. A braided sheet allows to obtain an homogeneous and relatively high mechanical strength.

The fibres' content in the substrate sheet is preferably lower than 50 grams/(meter)$^2$.

The substrate sheet preferably includes cellulose fibres. Cellulose fibres forming the sheet are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo.

The substrate sheet including fibres comprises fibres having a mean fibre length comprised between about 0.7 millimetres and about 50 millimetres. More preferably, the fibres of the substrate sheet including fibres have a mean fibre length comprised between about 1 millimetres and about 25 millimetres. More preferably, the fibres of the substrate sheet including fibres have a mean fibre length comprised between about 1 millimetres and about 10 millimetres. More preferably, the fibres of the substrate sheet including fibres have a mean fibre length comprised between about 1 millimetres and about 5 millimetres. Even more preferably, the fibres of the substrate sheet including fibres have a mean fibre length comprised between about 1.2 millimetres and about 1.8 millimetres.

The mean length of the fibres refers to their real length (regardless whether they are curled or have kinks) as measured by MORFI COMPACT commercialised by Techpap SAS. The mean length is the mathematical mean of the measured length of the fibres by MORFI COMPACT over a measurement of N fibres, where N>5. The MORFI COMPACT is a fibre analyser that measures the length of the fibres following the framework of the fibres, thus measuring their real developed length. Measured objects are considered fibres if their length is comprised between 200 microns and 10000 microns and their width is comprised between 5 microns and 75 microns. Fibers length is measured when deionized water is added to the fibres and Morfi software is used.

The substrate sheet defines a first surface and a second surface, one opposite to the other. The first surface or the second surface may be a substantially planar surface. The first surface or second surface may be horizontal, that is, parallel to an horizontal plane, or tilted.

The second surface is preferably in contact with the movable support, while on the first surface the slurry is deposited.

The slurry which comes into contact with the substrate sheet may be completely absorbed or adsorbed by the substrate sheet. The slurry may form a layer, called second layer, on the first surface of the substrate sheet. The slurry may be partly absorbed or adsorbed by the substrate sheet and partly coat the first surface of the substrate sheet.

Preferably, the application of the slurry may form a second layer on the substrate sheet. Substantially, a coating layer of slurry is formed on the first surface of the substrate sheet.

The application of slurry may impregnate the substrate sheet with slurry.

Depending on the composition of the substrate sheet or the composition of the slurry, or of both the compositions of the substrate sheet and of the slurry, for example depending on the amount of water or of binder contained in the slurry, the slurry may be absorbed or adsorbed minimally, in part, or for the most part by the substrate sheet. If the slurry is absorbed only minimally or in part by the substrate sheet, the second layer is formed on the surface of the substrate sheet where the slurry is applied and a multi-layered sheet is formed.

If a sorption process takes place, where slurry is absorbed or adsorbed by the substrate sheet, the substrate sheet becomes impregnated by slurry. The slurry can be completely absorbed by the substrate sheet. The slurry may also form both a coating layer and impregnate the substrate sheet.

Sorption is a physical and chemical process by which one substance becomes attached to another. Specific cases of sorption are: absorption, where the incorporation of a substance in one state into another of a different state takes place, such liquid slurry being absorbed by a solid substrate sheet; or adsorption, where the physical adherence or bonding of ions and molecules onto the surface of another phase takes place.

The resulting sheet formed by the substrate sheet and the slurry applied to the first surface may have a different composition in a cross section taken perpendicularly to the first surface of the substrate sheet. At the second surface, the lowest concentration of slurry may be present. At the first surface, the highest concentration of slurry may be present. In between the first surface and the second surface, a combination of substrate sheet's material and slurry may be present in different concentrations.

Preferably, the method includes the step of drying the parallel sheets of a material containing alkaloids simultaneously. After casting, the sheets are preferably dried to reduce their moisture content and to "harden" then. In order to dry the sheets, a drying station, shortly "dryer", can be used. All sheets are dried together speeding up the process. In addition, drying "smaller" sheets with respect to a wider one can lead to a more uniform drying of the sheets themselves minimizing resulting defects.

In the drying station, preferably the temperature of the sheets is raised, so that moisture inside the sheets can decrease. Preferably, the moisture of said sheets at casting—that is, the moisture of the slurry—is between about 60 percent and about 80 percent. Preferably, the moisture of said sheets at the end of the drying is between about 7 percent and about 15 percent of total weight of the sheets of material containing alkaloids. Preferably, the moisture of said sheets of material containing alkaloids at the end of drying is between about 8 percent and about 12 percent of total weight of the sheets of material containing alkaloids. The moisture of the slurry at casting and at the end of the drying process is an important parameter to control as it influences the homogeneity of the sheets and the manufacturability of the sheets of material containing alkaloids in subsequent production steps.

It has been found, that the ideal level of moisture of the slurry is between about 60 percent and about 80 percent. Below this preferred range, the density of the slurry at casting is such that it frequently causes the appearance of defects in the sheets which are formed. Also, a moisture level outside of this range may result in a reduced tensile strength of the sheets that may complicate efficient handling of the sheets of material containing alkaloids in subsequent processing steps. Therefore, the excess moisture that needs to be removed during the drying step from the sheets is relatively high.

The removal of moisture is performed preferably by exposure to a stream of a heated fluid. For example, the heated fluid can be drying air, wherein the drying air has a higher temperature than the temperature of the cast sheet. Steam could be used as well.

Preferably, the step of supplying slurry from the outlets on a movable support includes the step of spraying or ejecting the slurry onto the movable support. In order to supply the slurry from the tank to the movable support, the slurry can be sprayed or ejected, for example by suitable nozzles or guns, onto the movable support. A simple and effective sheets' formation is therefore achieved.

Preferably, the method includes the step of regulating the pressure or the flow rate of the slurry supplied from each outlet of the plurality independently. Preferably, at least one flow rate of an outlet is regulated independently from the others. More preferably, the method includes the step of changing the pressure of the slurry supplied from each outlet of the plurality on the basis of the flow rate of the slurry supplied from the same outlet. The amount and pressure of the slurry exiting each outlet is preferably monitored. This monitoring may be part of a feedback loop, so that the pressure at which the slurry is ejected or sprayed onto the movable support may be varied depending on the amount of slurry per unit time which is forced onto the movable support. An optimal distribution of slurry onto the movable support is therefore obtained. In addition, the amount of slurry used to form each of the sheets of the plurality is preferably the same.

Preferably, the method includes the step of stirring the slurry in the tank. The slurry is generally reaching the tank already in a mixed state. In order to obtain a slurry having substantially the same characteristics at all outlets in the tank, which are positioned at different locations, stirring is also preferably performed inside the tank, for example by means of a mixing device, such as a screw conveyor. In addition, a constant stirring or mixing avoids that some portions of the slurry dry.

Preferably, the method includes the step of heating the slurry at one or more outlets of the plurality or inside the tank. A "hot" slurry is a less viscous slurry so it is more easily distributed onto the movable support, in particular by spraying or ejecting. Preferably, the temperature of the slurry at the outlet is comprised between about 20 degrees Celsius and about 50 degrees Celsius.

Preferably, the method includes orienting a flow of slurry supplied from one or more of the outlets of the plurality with respect to the movable support.

Preferably, it is possible to adjust the direction in which the slurry from the tank reaches the movable support. Preferably, also the shape of the stream of slurry can be changed. In this way, it is possible to tailor the stream of slurry to the desired sheets to be obtained, achieving a better accuracy in the sheet formation.

The invention also relates to an apparatus for the production of a plurality of sheets of material containing alkaloids, the apparatus comprising: a tank adapted to contain a slurry having a plurality of outlets; a movable support adapted to move along a transport direction; a plurality of separators positioned parallel to the transport direction and in contact to a surface of the movable support, the separators dividing the surface of the movable support in a number of sections; wherein each of the outlets of the plurality is located above a section.

Advantages of such apparatus have been already described with respect to the method and are not repeated herein. The slurry from the tank is transferred via the outlets to the movable support. In order to keep the slurry sheets separated one from the other, the movable support on one of its surface, preferably the surface facing the tank, includes a plurality of separators so that the slurry forming the various sheets is "confined" in its space defined by the separators, that is, it is confined to a limited portion of the surface of the movable support.

Each outlet feeds a section of the movable support formed by the separators. Preferably, each outlet of the plurality feeds a different section, however also configurations where more than an outlet feed the same section is possible.

Preferably, the apparatus includes a spraying or ejection gun at each of the outlet of the plurality. The gun, for example positioned at an end of a pipe extending from each outlet, is used to spray or eject slurry onto its section of the movable belt.

Preferably, the apparatus includes a pressure regulator at each of the outlet of the plurality. Preferably, the apparatus includes a flow meter at each of the outlet of the plurality. Preferably, there is a control of parameters of the flow of slurry from the tank to the movable support.

Preferably, a width of the sections in a direction perpendicular to the transport direction is preferably comprised between about 10 millimetres and about 300 millimeters. Preferably, the width of each sheet of the plurality is such that it is equal or similar to the "standard" width of the small bobbins obtained splitting the "master" sheet, so that the small sheets can be immediately undergo further process steps to obtain for example an aerosol-generating article.

Preferably, a height of the sections in a direction perpendicular to the transport direction is preferably comprised between about 10 millimetres and about 100 millimetres. Preferably, the thickness of each sheet of the plurality is comprised between about 5 millimetres and about 20 millimetres. Preferably, the thickness of all sheets of the plurality is substantially the same. The height of the sections, where with height it is intended a dimension substantially perpendicular to the surface of the movable support onto which the slurry is deposited, is wide enough to contain the amount of slurry needed to obtain such a sheet's thickness.

Preferably, a dimension or shape of each outlet of the plurality is changeable. The outlet's dimension and/or shape can change to better control the flow of slurry.

The invention will be now better described with reference to the appended drawings, where:

Figure 1:
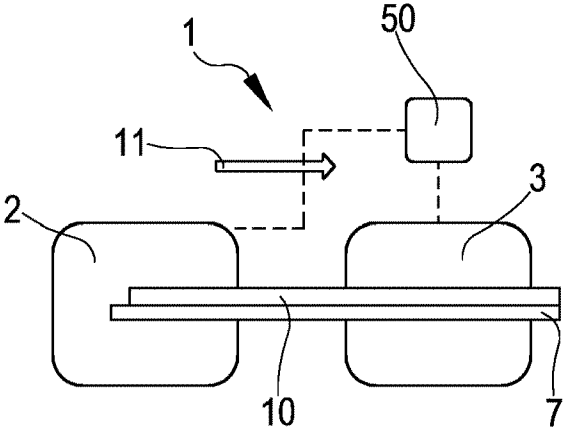
FIG. 1 is a schematic view of an apparatus for the production of a plurality of sheets of material containing alkaloids according to the invention.

With initial reference to FIG. 1, an apparatus for the production of a plurality of sheets of a material containing alkaloids, all indicated with 10, according to the present invention is represented and indicated with reference number 1. In this embodiment, the plurality of sheets 10 are sheets of homogenized tobacco material.

The apparatus 1 for the production of a plurality of sheets of homogenized tobacco material includes a sheets' forming apparatus 2 and further preferably also a drying apparatus 3 positioned downstream the sheets' forming apparatus 2 in the direction of motion 11 (shown as an arrow in FIG. 1) of the plurality of sheets of a material containing alkaloids 10.

Figure 2:
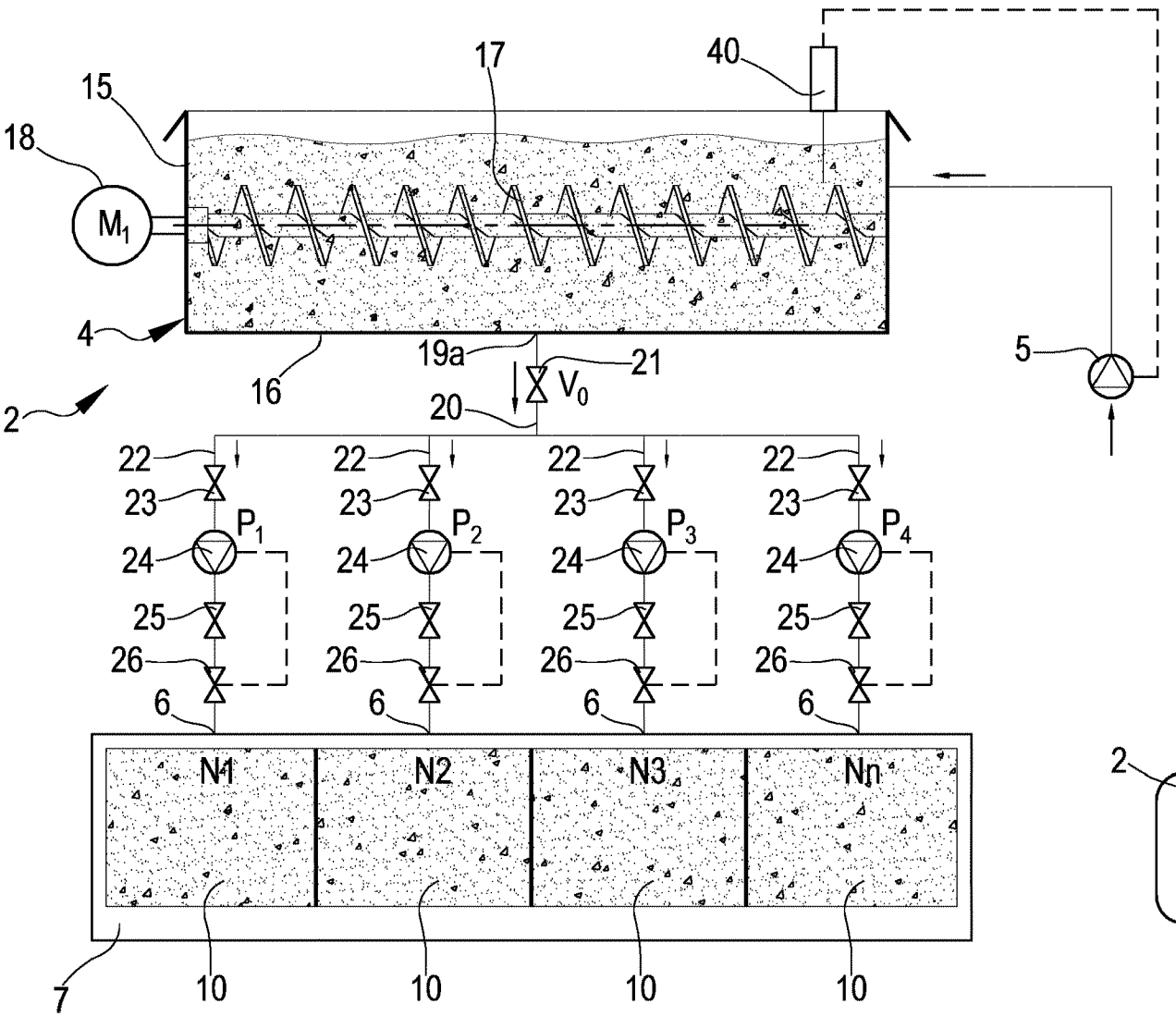
FIG. 2 is a more detailed front view of the apparatus of FIG. 1

With now reference to FIG. 2, the sheets' forming apparatus 2 comprises a tank 4 where slurry to form the webs of homogenized tobacco material is introduced, a pump 5 to introduce the slurry into the tank, a plurality of outlets all indicated with 6 and a movable support 7 onto which the slurry is delivered from the outlets 6. Tank 4 may have any geometrical shape, and in the depicted embodiment it is substantially a prism. Slurry from buffer tanks or silos (not shown in the drawings) is transferred by means of the pump 5 into the tank. Preferably pump 5 comprises a control (not visible in the drawing) of flow rate to control the amount of slurry introduced in the tank 4. Pump 5 is advantageously designed to ensure that slurry transfer times are kept to the minimum necessary. Further, a sensor 40 is present in the tank 4 to measure the level of the slurry. Preferably, a feedback is present between the sensor 40 and the pump 5 so that the optimal level of slurry is constantly substantially kept in the tank 4.

Tank 4 includes lateral walls 15 and also further includes a bottom wall 16. A mixer 17 can be present inside the tank to stir and/or mix the slurry. The mixer can be for example a screw conveyor driven into motion by a motor 18.

The sheets' forming apparatus 2 also comprises the movable support 7 on which the slurry is supplied to form the webs of homogenized tobacco material 10. The movable support 7 comprises for example a continuous stainless belt 7 comprising a drum assembly. The drum assembly includes a main drum 8 (visible in drawings 3-5) located below the tank 4 which moves the movable support 7. Preferably, the tank 4 is mounted on top of the main drum 8. The transport direction of the movable support 7 corresponds to the direction of motion 11.

Preferably, the width of the tank 4 (where with width the direction perpendicular to the transport direction 11 is indicated) is preferably substantially identical to the width of the movable support 7.

In the bottom wall 16 of the tank an aperture 16*a* is formed connected to a main pipe 20. A main valve 21 regulates the flow of slurry through the main pipe 20. Downstream the main valve 21, in the direction of flow of the slurry, the main pipe 20 branches off in a plurality of branch pipes, all indicated with 22. The number of branch pipes 22 is equal to the number of outlets 6 and indeed each branch pipe 22, at its free end, terminates with an outlet 6.

In a different embodiment, not shown, a plurality of apertures is formed directly to the bottom wall 16 and a plurality of pipes is connected, each pipe to a different aperture.

Each branch pipe comprises a valve 23 followed by a volumetric pump 24, for example a lobe pump or a gear pump, a pressure regulator 25 and a flow meter 26. The elements 23-26 are listed in the direction of flow of the slurry, from the most upstream (valve 23 located downstream main valve 21) to the most downstream one (flow meter 26). Preferably, the flow meter 26 and the volumetric pump 24 are part of a feedback system, so that the value outputted by the flow meter 26 regulates the volume of slurry delivered by the pump 24 trough pipe 22.

Figure 3:
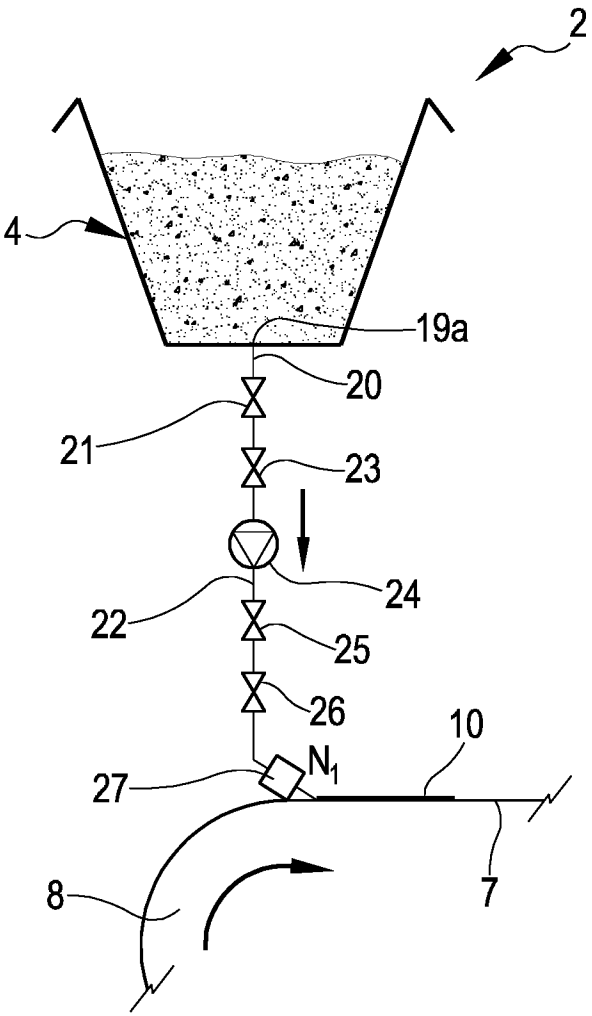
FIG. 3 is a schematic more detailed lateral view of a portion the apparatus of FIG. 1.

The sequences of elements is shown in FIG. 3, where a side view of the sheets' forming apparatus 2 is taken.

Each branch pipe 22 terminates with a gun 27 where the outlet 6 is present. Each gun 27 includes a nozzle (not visible) representing the outlet, the nozzle might be a slit, for example for injected slurry, or a circle for sprayed slurry.

The gun 27 may be an ejector gun or a spraying gun. In both systems, i.e. with ejection or spraying gun, may be possible to adjust the position and/or the inclination of the gun. Further, compressed air may be used to push the slurry out with air pressure regulator. In case of ejection guns, preferably the outlet has an adjustable shape and dimensions. In case of ejection guns, preferably they are provided with adjustable spraying shape (cone, spiral, etc.).

Guns 27 are preferably forming a line, that is, they are aligned along an axis, and this line is preferably perpendicular to the transport direction 11.

Further, each branch pipe 22 may include an electrical heating element and a temperature sensor (not shown in the drawings). The heating is used in order to prevent slurry cooling during the transfer.

Figure 5:
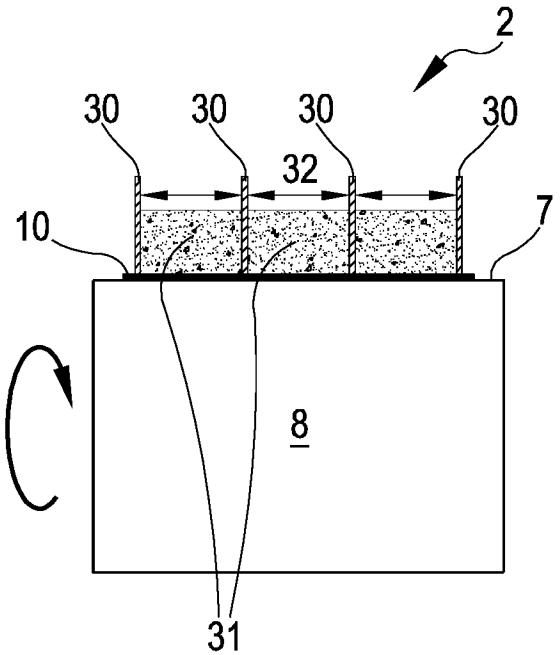
FIG. 5 is a front view in section of the detail of FIG. 3.
Figure 4:
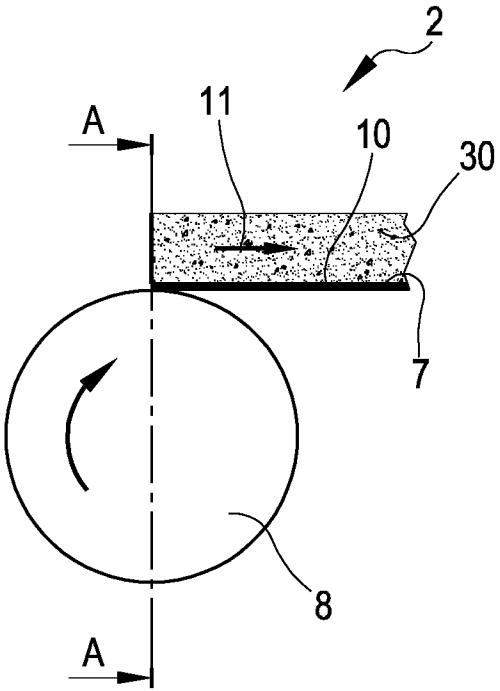
FIG. 4 is a lateral view of a detail of the apparatus of FIG. 1.

As better visible in FIGS. 4 and 5, the movable support 7 defines a surface 7*a*. The surface 7*a* is preferably planar. The movable support 7 includes a plurality of separators 30 positioned on the surface 7*a* of the movable support 7 in contact with the slurry. The separators 30 divide the surface 7*a* of the movable support in sections 31. Separators 30 preferably include walls, such as vertical walls, which are parallel to each other. The walls are parallel to the transport direction 11 and connected with screws to the belt so they move/loop together with the belt. The width 32 of each section is preferably the width of the standard "small bobbins" (for example preferably between about 10 millimetres and about 300 millimetres) used for further processing the sheet 10. The width 32 of all sections is preferably the same.

Preferably, a gun 27 is associated to each section 31. Each gun 27 has his section to cover in slurry.

Further, preferably additional sensors (not shown) are preferably arranged above the movable support 7 to measure the weight per square centimetre and the thickness of the homogenized tobacco layer on the movable support 7. The sensor may be for example a nucleonic measuring head. Additional sensors, still not shown in the drawings, are preferably present as well, such as a sensor to locate and determine the positions of defects in the cast web of homogenized tobacco, a sensor to determine the moisture of the slurry and of the parallel sheets 10, and a temperature sensor for determining the temperature of the slurry in the tank 4.

Preferably, all the sensors send signals relative to their respective parameters to be measured (temperature, moisture slurry level, defects, and so on) to a central control unit 50 (see FIG. 1). Central control unit 50 is preferably electrically connected to one, to some or to all of pumps 5, 24, actuators, motors 18, sensors 40, guns 27, flow meters 26 or to further circuits and actuators in the apparatus 2 or in a slurry preparation apparatus (not visible). In case the sheets 10 reveal defects or inhomogeneity or the characteristics of the sheets 10 are outside a pre-set range, the central control unit 50 can instruct changes in the process parameters and thus influence characteristics of the slurry or the parameters of the sheets' formation. These process parameters may be for example any of: the dimension of the nozzles in the guns 27, the flow rate of the slurry, the temperature of the slurry, the shape of the spray, or the amount of slurry in the tank 4, or a combination thereof.

The drying apparatus 3 includes a plurality of individual drying zones. Each drying zone preferably includes steam heating on the bottom side of the support and heated air above the movable support 7 and preferably also adjustable exhaust air control. Within the drying apparatus 3, the homogenized tobacco web is dried to desired final moisture on the support 7.

Figure 6:
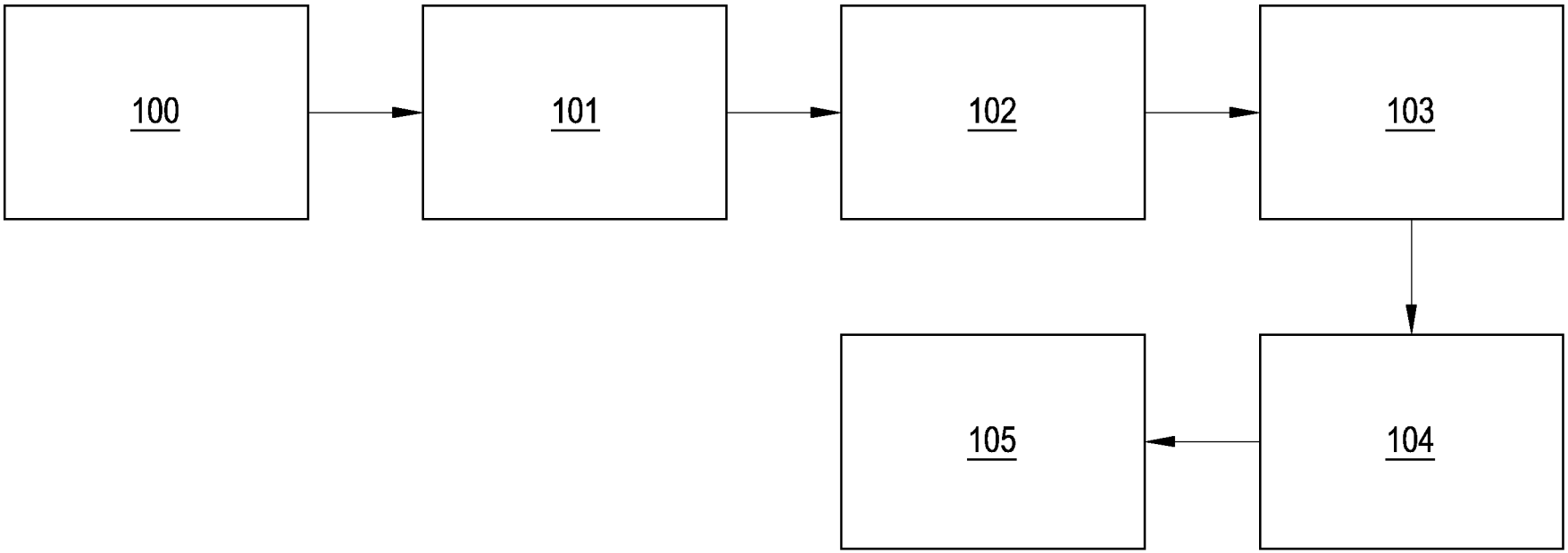
FIG. 6 is a flow chart of a method for the production of a plurality of sheets of material containing alkaloids according to the invention.

With now reference to FIG. 6, the functioning of the apparatus 1 including the sheets' forming apparatus 2 is as follows. A slurry, formed preferably mixing and combining tobacco powder, water and other ingredients, is transferred from a holding tank (not shown) using for example in line mixers (also not shown) to the sheets' forming apparatus 2 inside the tank 4 in step 100. The step 101, main valve 21 is opened and the slurry reaches branch pipes 22. Guns 27 are thus operated in step 102 so that the slurry is supplied onto the movable support 7, for example the stainless steel belt 7. Each gun 27 deposits slurry on a different section 31 realized in the movable support 7. Further, any of steps 100-102 preferably includes monitoring the level of slurry in the tank 4, the moisture of the slurry inside the tank 4, and the density of the slurry, by means of suitable sensors.

The thickness of the sheets 10 and grammage controlled by nucleonic gauge immediately after casting are continuously monitored and feedback-controlled using slurry measuring device. The sheets' formation is performed by means of the guns 27 that spray or inject slurry in the different sectors 31 provided in the movable support 7. Due to the walls 30, the sheets remains separated while transported.

Further, the sheets 10 undergo a drying step 103 by means of the drying apparatus 3. The sheets 10 continue to travel on the movable support so that they enter the dryer together, thus their drying is preferably simultaneous. The drying step includes preferably a uniform and gentle drying of the sheets in an endless, stainless steel belt dryer with individually controllable zones. During the drying, a monitoring step (not shown) of the sheets' temperature at each drying zone to ensure a gentle drying profile at each drying zone is preferably performed. The webs are dried to desired final moisture on the steel belt 7 with steam pan heating from bottom and top air drying. Every drying zone is equipped with steam flow and pressure control and air temperature and air flow are fully adjustable to provide the desired drying profile and ensuring product residence time is respected.

Preferably, at the end of the drying step 103, the sheets of homogenized tobacco material are removed from the support 7, for example by means of a doctoring blade. Doctoring 104 of the sheets after the drying station at the right moisture content is preferably performed.

After the drying step 103, the sheets 10 are preferably wound in several "small" bobbins in a winding step 105. The bobbins may then be used for the production of an aerosol-generating article (not shown).

The invention claimed is:

1. An apparatus for the production of a plurality of sheets of material containing alkaloids, the apparatus comprising:

a tank adapted to contain a slurry having a plurality of outlets; and a movable support comprising a single belt conveyor adapted to move along a transport direction, the movable support further comprising a plurality of separators positioned parallel to the transport direction and positioned on a surface of the single belt conveyor, the separators dividing the surface of the single belt conveyor in a number of sections;

wherein each of the outlets of the plurality is located above a section.

2. The apparatus according to claim 1, including a spraying gun or an ejection gun at each outlet of the plurality.

3. The apparatus according to claim 1, including a pressure regulator at each outlet of the plurality.

4. The apparatus according to claim 1, including a flow meter at each outlet of the plurality.

5. The apparatus according to claim 1, wherein a width of the sections in a direction perpendicular to the transport direction is preferably comprised between about 10 millimetres and about 300 millimetres.

6. The apparatus according to claim 1, wherein a height of the separators in a direction perpendicular to the transport direction is preferably comprised between about 10 millimetres and about 100 millimetres.

7. The apparatus according to claim 1, wherein a dimension or shape of each outlet of the plurality is changeable.

* * * * *